US009347267B2

(12) United States Patent
Koch et al.

(10) Patent No.: US 9,347,267 B2
(45) Date of Patent: May 24, 2016

(54) HORIZONTAL DRILLING DEVICE

(75) Inventors: Elmar Koch, Eslohe (DE); Sebastian Fischer, Lennestadt (DE); Andreas Joachim Hanses, Habichtstrasse (DE)

(73) Assignees: GDF SUEZ, Paris (FR); TRACTO-TECHNIK GmbH & Co. KG, Lennestadt (DE)

( * ) Notice: Subject to any disclaimer, the term of this patent is extended or adjusted under 35 U.S.C. 154(b) by 683 days.

(21) Appl. No.: 13/638,316

(22) PCT Filed: Mar. 31, 2011

(86) PCT No.: PCT/EP2011/001617
§ 371 (c)(1),
(2), (4) Date: Nov. 26, 2012

(87) PCT Pub. No.: WO2011/120697
PCT Pub. Date: Oct. 6, 2011

(65) Prior Publication Data

US 2013/0105225 A1 May 2, 2013

(30) Foreign Application Priority Data

Mar. 31, 2010 (DE) ..... 10 2010 013 724

(51) Int. Cl.
*E21B 7/04* (2006.01)
*E21B 49/06* (2006.01)
*E21B 19/20* (2006.01)

(52) U.S. Cl.
CPC ..... *E21B 7/046* (2013.01); *E21B 19/20* (2013.01); *E21B 49/06* (2013.01)

(58) Field of Classification Search
CPC ..... E21B 7/046; E21B 49/06; E21B 19/20
See application file for complete search history.

(56) References Cited

U.S. PATENT DOCUMENTS

| | | | | |
|---|---|---|---|---|
| 4,714,119 | A * | 12/1987 | Hebert et al. | 175/20 |
| 4,892,161 | A | 1/1990 | Ebeling | |
| 5,411,106 | A * | 5/1995 | Maissa et al. | 175/78 |
| 5,425,429 | A * | 6/1995 | Thompson | 175/62 |
| 5,617,927 | A * | 4/1997 | Maissa | 175/78 |
| 6,050,351 | A * | 4/2000 | Eckenfels et al. | 175/62 |
| 7,530,407 | B2 * | 5/2009 | Tchakarov et al. | 175/20 |
| 7,726,028 | B2 | 6/2010 | Koch et al. | |
| 7,824,130 | B2 | 11/2010 | Koch et al. | |
| 8,075,224 | B2 | 12/2011 | Koch et al. | |
| 8,413,311 | B2 | 4/2013 | Koch et al. | |

(Continued)

FOREIGN PATENT DOCUMENTS

| | | | |
|---|---|---|---|
| CN | 85202963 | U | 7/1987 |
| CN | 1217416 | A | 5/1999 |
| DE | 37 43 706 | C1 | 2/1989 |
| DE | 196 33 934 | A1 | 2/1998 |

(Continued)

OTHER PUBLICATIONS

International Search Report dated Oct. 11, 2012 for related International application PCT/EP2011/001617.

*Primary Examiner* — Nicole Coy
(74) *Attorney, Agent, or Firm* — Howard IP Law Group

(57) ABSTRACT

A horizontal drilling device according to the invention includes a linear drive, a rotary drive that can be displaced by means of the linear drive, a drill rod assembly and a rod assembly pipe receiver, the drill rod assembly being hollow and the rod assembly receiver being designed as a receiving mandrel, which allows the drill rod assembly to be placed on the receiving mandrel.

9 Claims, 11 Drawing Sheets

(56) References Cited

U.S. PATENT DOCUMENTS

| | | | | |
|---|---|---|---|---|
| 8,882,393 | B2 | 11/2014 | Koch et al. | |
| 2004/0188144 | A1 * | 9/2004 | Volkel | E21B 19/20 175/62 |
| 2011/0168286 | A1 | 7/2011 | Koch et al. | |
| 2013/0199851 | A1 | 8/2013 | Koch et al. | |
| 2013/0277118 | A1 | 10/2013 | Koch et al. | |

FOREIGN PATENT DOCUMENTS

| | | | |
|---|---|---|---|
| DE | 10136967 | C2 | 10/2003 |
| DE | 10302193 | A1 | 12/2003 |
| EP | 0825326 | B1 | 9/2004 |
| JP | 01268984 | A | 10/1989 |
| JP | 03194094 | A | 8/1991 |
| WO | WO 03/012248 | A2 | 2/2003 |

* cited by examiner

HORIZONTAL DRILLING DEVICE

CROSS-REFERENCES TO RELATED APPLICATIONS

This application is the U.S. National Stage of International Application No. PCT/EP2011/001617, filed Mar. 31, 2011, which designated the United States and has been published as International Publication No. WO 2011/120697 A1 and which claims the priority of German Patent Application, Serial No 10 2010 013 724.3, filed Mar. 31, 2010, pursuant to 35 U.S.C. 119(a)-(d).

BACKGROUND OF THE INVENTION

The invention relates to a horizontal drilling device.

Horizontal drilling devices are used to introduce supply and disposal lines into the ground in trenchless construction or to exchange already installed old lines in a trenchless manner.

There are many different horizontal drilling devices. Common are horizontal drilling devices in which a drill head is initially advanced angled into the ground by means of a drill rod assembly and starting from a drill boom positioned above ground until the drill head has reached the desired drilling depth. Then, the drill head is redirected into the horizontal position in order to carry out the horizontal drilling. The target point of such a horizontal drilling can for example be located in a target excavation pit which is excavated for this particular purpose or in a basement room or it can also be located above ground i.e., like the starting point, so that the drill head after a defined drilling progress is redirected into a diagonally upwards pointing direction, to let the drill head reemerge above ground.

After the drill head has reached the target point, it is often replaced for a widening device for example a conical widening body, to widen the previously generated (pilot) bore by means of the drill boom when retracting the drill rod assembly. This may involve attaching a new line to be drawn into the widening device, to draw the new line into the ground simultaneous with the widening of the pilot bore.

Horizontal drilling devices are also used to replace old lines in the ground in a trenchless manner. For this, in a first step the drill rod assembly is pushed by the drill boom along the old line (and in particular through an old line) and after reaching a target point, which can for example be located in a maintenance shaft of the sewage system, the front end of the drill rod assembly is connected with a widening device which cuts or bursts the old line when retracting the drill rod assembly, wherein the fragments of the destroyed old line are radially displaced into the soil. At the same time, a new pipe can be drawn into the old pipe. Destroying the old pipe and displacing the fragments of the old pipe allows the new pipe to have an outer diameter which corresponds to the outer diameter of the old pipe or even exceeds this diameter.

As an alternative, an adapter can be connected to the front end of the drill rod assembly which adapter engages on the rear end of the old line and pulls the old line out of the ground when retracting the drill rod assembly. This allows avoiding that fragments of a destroyed old line remain in the ground which may otherwise cause damage to the new pipe due to sharp-edged brakeage edges and the pressure exerted by the surrounding soil.

Horizontal drilling devices usually have a linear drive with which the drill rod assembly can be advanced and retracted within the ground. Further, a rotational drive is usually provided with which the drill rod assembly (and with this the drill head and widening head connected thereto) can be rotated. The rotation of the drill head or the widening device allows improving the advance in the soil.

Further, most of the steerable horizontal drilling devices require a rotation of the drill head to steer the drill head into a desired drilling direction. The drill heads of such horizontal drilling devices have an asymmetrically formed (for example slanted) drill head front, which leads to a lateral deflection of the drill head during movement through the soil. When the drill head is simultaneously rotatingly driven when being advanced in the soil, the asymmetric configuration of the drill head has no influence on the straight drilling course, because the lateral deflection evens out over a rotation. On the other hand, when the rotation of the drill head is stopped and the drill head is exclusively advanced by pushing—optionally supported by strokes of a stroke device which is integrated in the drill head or in the drill boom—the asymmetric configuration of the drill head leads to a (constant) lateral deflection. This achieves an arched drilling course and as a result a change of the drilling direction.

Horizontal drilling devices which are exclusively intended for replacing old pipes which are already installed in the ground often have no additional rotational drive.

Horizontal drilling devices in which the drill boom is intended for positioning above ground often can only be used in non-urban areas because the horizontal drilling devices have to be positioned at a considerable distance to the region in which the bore or the new line is to be introduced into the ground or in which an already existing old pipe is to be exchanged, due to the drilling distance required to reach the desired drilling depth. Oftentimes, corresponding special requirements are not available in built-up areas. A further disadvantage of such horizontal drilling devices is that these drilling devices which are commonly configured as self-propelled drill boom, cause significant crop damage which has to be remedied by a corresponding financial effort.

Because of these disadvantages, the trenchless line construction in built-up areas is limited to the trenchless replacement of old pipes because the old pipes always extend between subterranean hollow spaces (in particular supply shafts and basement rooms) which are already present and which can be used for the positioning of the horizontal drilling device. Excavation work and as a result, crop damage can thus mostly be prevented. Horizontal drilling devices have been developed which are configured so that they can be positioned in a supply shaft. Because new supply lines often are not to be installed along existing supply routes these horizontal drilling devices are often not available for newly installing supply lines.

From DE 196 33 934 A1 a horizontal drilling device is known which is configured for use in small excavation pits with a square cross section of about 70 cm×40 cm and a depth of about 1 m to 1.5 m. These horizontal drilling devices include a frame whose dimensions roughly correspond to the cross sectional dimensions of the excavation pit and are lowered into the excavation pit. A part of the frame protrudes over the upper edge of the excavation pit. In the section of the frame which is located inside the excavation pit, a combined linear/rotary drive is provided via which a drill rod assembly which is composed of individual rod assembly sections is advanced into the soil. The linear/rotational drive includes a rotational drive which can be moved within the frame in horizontal direction by means of the linear drive which is formed by two hydraulic cylinders. For advancing the drill rod assembly, the last rod assembly section is force fittingly fixed in the rotational drive for which the rotational drive has clamp jaws. The rod assembly sections which are successively screwed to the rear end of the already drilled drill rod assembly are supplied to the linear/rotational drive via a rod assembly lift which transports the rod assembly sections from a rod assembly magazine which is arranged in the upper section of the frame which protrudes over the edge of the excavation pit. The rod assembly lift includes a changer motor whose motor shaft is provided with a threaded pin. The threaded pin is screwed into the rear end of a rod assembly section which is to be transported to the linear/rotational drive. By displacing the changer motor along the rod assembly lift, the rod assembly section can then be transported to a position which is axial to the drilling axis. The changer motor with the threaded pin represents a rod assembly receiver in which the rod assembly section is held until it is gripped by the rotational drive and connected to the drill rod assembly.

In most of the other conventional horizontal drilling devices the rod assembly receiver is integrated into the rotational drive. In this case the rotational drive has for example a threaded socket which is screwed into the inner threading of the rear end of a rod assembly section. By rotating the rotational drive, the rod assembly section is then first screwed to the rear end of the drill rod assembly and then if needed, the entire drill rod assembly is rotated during advance through the soil.

The horizontal drilling device known from DE 196 33 934 A1 enables introducing bores into the ground starting from any desired starting positions. Because only a relatively small excavation pit is required for the positioning of the horizontal drilling device and the horizontal drilling device can also be transported easily owing to the compact design, its use is associated with relatively small crop damages.

A disadvantage of the horizontal drilling device known from DE 196 33 934 A1 is that due to the coaxial orientation of the changer motor, the new rod assembly section and the drill rod assembly, only relatively (compared to the length of the frame) short rod assembly sections can be used. The shorter the individual rod assembly sections, the more frequently new rod assembly sections have to be attached to the rod assembly in order to introduce the bore with the desired length into the ground. The attachment or release of the rod assembly section is associated with significant time consumption.

Proceeding from this state of the art, the invention is based on the object to provide an improved horizontal drilling device. In particular, a horizontal drilling device was intended to be proposed which enables the use of rod assembly sections which are as long as possible.

SUMMARY OF THE INVENTION

This object is solved by the subject matter of the independent patent claim. Advantageous refinements of the horizontal drilling device according to the invention are the subject matter of the dependent patent claims and follow from the following description of the invention.

The invention is based on the idea to provide rod assembly sections for the drill rod assembly which are as long as possible in order to require as few as possible rod assembly changes (i.e., attachment or release of a rod assembly section to/from the rod assembly) for a drilling project with a defined bore length. In drilling devices which—as known from DE 196 33 934 A1—are arranged in a small dimensioned excavation pit, the maximal length of the rod assembly sections is limited by the dimensions of the excavation pit in the direction of the drilling axis. Such drilling devices further pose the problem of handling of the rod assembly sections during the rod assembly change. In the drilling device of DE 196 33 934 A1 the rod assembly sections are held by the rod assembly receiver (changer motor with threaded sockets) during rod assembly change. Because this rod assembly receiver is positioned in coaxial position behind the rod assembly section, the possible maximal length of the rod assembly sections is decreased by at least the length of the rod assembly receiver.

In order to be able to insert rod assembly sections which are as long as possible, it is provided according to the invention to reduce the space required by the rod assembly receiver itself to a minimum so that the thus gained space is available for increasing the length of the rod assembly sections. This is achieved in that the rod assembly receiver is configured in the shape of a receiving mandrel onto which the hollow configured rod assembly sections of the rod assembly are plugged.

The horizontal drilling device according to the invention has a linear drive, a rotational drive which is displaceable by means of the linear drive, a drill rod assembly and a rod assembly receiver, wherein the drill rod assembly is hollow and the rod assembly receiver is configured in the shape of a receiving mandrel, which allows the rod assembly to be plugged onto the receiving mandrel.

Configuring the rod assembly receiver in the shape of a receiving mandrel allows achieving a secure fixing of the rod assembly section held therein with a protrusion (i.e., the section of the rod assembly receiver which extends past the length of the rod assembly section) which is as small as possible.

Compared to threaded sockets known in most of the conventional horizontal drilling devices, a rod assembly receiver in the shape of a receiving mandrel has the advantage that the attachment can be carried out significantly faster and when the receiving mandrel and the corresponding inner cross section of the rod assembly sections—as is preferably provided—have a circular cross section, the drill rod assembly is movable on the receiving mandrel in axial as well as in rotational direction. This allows realizing further functions as will be seen from the following description.

In a preferred embodiment of the horizontal drilling device according to the invention, the receiving mandrel is pivotal between a first position which is parallel to the direction of movement of the linear drive, and a second position which is preferably oriented perpendicular to the first position. This advantageously allows providing the horizontal drilling device according to the invention with a rod assembly lift which is provided for the transport of a rod assembly section of the drill rod assembly to the receiving mandrel. The rod assembly section is preferably attachable from the rod assembly lift onto the receiving mandrel when the receiving mandrel is in the second position, and the rod assembly section can be supplied to the rotational drive when the receiving mandrel is in the first position. The pivotabiltiy of the receiving mandrel thus makes it possible to transport the relatively long rod assembly sections of the drill rod assembly in a vertical orientation by means of the rod assembly lift and to attach the rod assembly sections in this orientation onto the receiving mandrel and subsequently, by pivoting the receiving mandrel, to pivot the rod assembly lift into a horizontal position required for the drilling, in which the rod assembly section is in an axial position relative to the drilling direction.

In a further preferred embodiment of the horizontal drilling device according to the invention, the rod assembly receiver has a travel drive to allow displacement of the rod assembly receiver and the rod assembly section disposed thereon in horizontal direction. This allows for example attaching the rod assembly section to the rear end of the already drilled rod assembly (in the soil) without having to use the linear drive of the horizontal drilling device, as is the case in conventional horizontal drilling devices.

In a further preferred embodiment of the horizontal drilling device according to the invention, the receiving mandrel is configured hollow as well, and a supply for a drilling fluid is connected to the receiving mandrel. The rod assembly receiver of the horizontal drilling device according to the invention can thus additionally serve as connection element to conduct a drilling fluid to the drill rod assembly or the drill head which is attached front-side to the drill rod assembly during drilling. One or multiple sealing(s) on the receiving mandrel can prevent an undesired leakage of drilling fluid. The preferably provided rotatability of the rod assembly section on the receiving mandrel allows realizing the function of a rotary feed-through as it is required for supplying rotatingly driven drill rod assemblies with a drilling fluid. The preferably provided displacability of the rod assembly receiver is also useful for the function of the receiving mandrel as connection element for supply with drilling fluid in order for the latter to be supplied during drilling of the drill rod assembly.

Preferably, the connection for the drilling fluid supply can be integrated in a pivot joint of the receiving mandrel. This allows achieving a constructively simple yet robust integration of the drilling fluid supply.

BRIEF DESCRIPTION OF THE DRAWING

In the following, the invention is explained in more detail by way of an exemplary embodiment shown in the drawings.

In the drawings it is shown in.

DETAILED DESCRIPTION OF PREFERRED EMBODIMENTS

Figure 1:
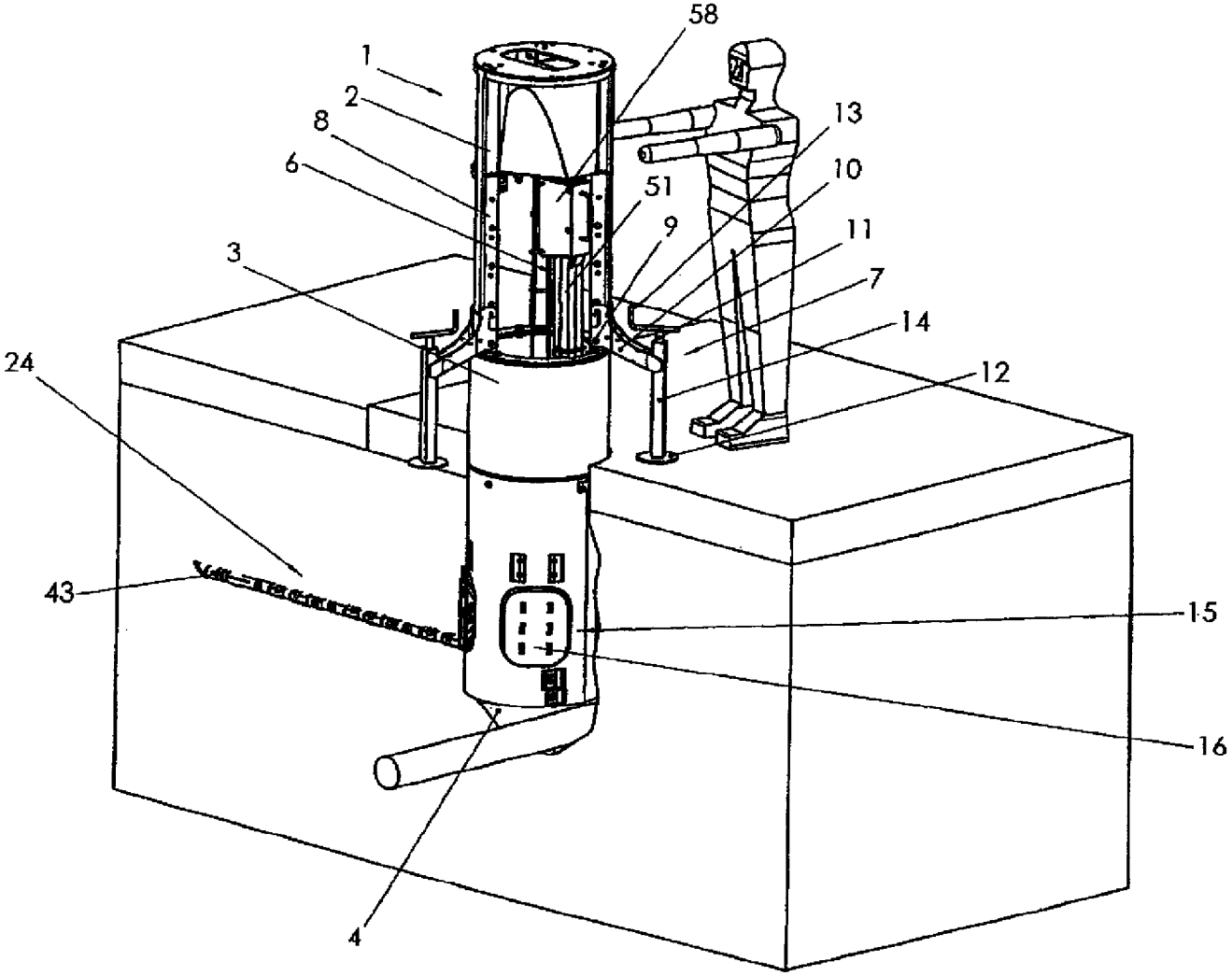
FIG. 1 a horizontal drilling device according to the invention in a perspective view.

FIG. 1 shows in an isometric view a horizontal drilling device according to the invention 1 during the introduction of a pilot bore into the soil.

The horizontal drilling device includes a cylindrical housing 2, which is partially closed via a cylindrical sheath 3. Functionally, the horizontal drilling device 1 or respectively, the housing 2 of the horizontal drilling device 1 is divided into two sections, namely a lower section referred to as "pit section", which is located within an excavation pit 4 which was excavated especially for receiving the horizontal drilling device 1. In the pit section of the horizontal drilling device 1 the housing 2 is essentially completely closed by the sheath 3. This prevents that soil which becomes dislodged from the walling of the excavation pit 4 falls into the hollow space which is formed in the housing 2 where further functional elements of the horizontal drilling device 1 and in particular a combined linear/rotational drive 5 are located. Soil which falls into the hollow space might otherwise contaminate these functional elements thereby impairing the function of the horizontal drilling device 1.

In the upper section of the horizontal drilling device 1 according to the invention, also referred to as "surface section", the housing 2 is partially configured open in order to provide access for operating personnel to a rod assembly lift 6 which extends as far as into this region.

The horizontal drilling device 1 is positioned "suspended" within the excavation pit i.e., the horizontal drilling device 1 is supported not on the floor of the excavation pit 4, but rather via a support device with a total of three support legs 7 which are fastened in the region of the surface section of the horizontal drilling device 1 on longitudinal supports 8 of the housing 2. Each of the support legs 7 can be fastened to a total of five different points on the respective longitudinal support 8. This allows for a height adjustment of the horizontal drilling device 1 which is suspended in the excavation pit 4. This height adjustment is important, for example for positioning the linear/rotational drive 5 which is located in the pit section, at the correct height for introducing the pilot bore into the soil. A fixing of the support legs 7 at the different points along the longitudinal supports 8 occurs via a respective transverse bolt 9, which is inserted through a through-bore in a transverse support 10 of the respective support leg 7 and the respective longitudinal support 8 of the housing 2, and is then fixed.

Each of the support legs 7 further has a spindle support which is connected to the transverse support 10 of the respective support leg 7 via a pivot joint. The spindle support includes a threaded rod 11 which has a support foot 12 on its foot end. A handle 13 is provided on the end of the threaded rod 11 which is opposite the support foot 12 via which handle 13 the threaded rod 11 can be rotated about its longitudinal axis, thereby achieving a longitudinal displacement relative to the spindle housing 14 which surrounds the threaded rod. The spindle supports serve for accurately orienting the horizontal drilling device 1 within the excavation pit 4 after a first height adjustment was already achieved by the fastening of the support legs 7 on the longitudinal supports 8 of the housing 2.

It can be recognized in FIG. 1 that the excavation pit 4—like the housing 2 of the horizontal drilling device 1—has a (substantially) cylindrical shape whose inner diameter essentially corresponds to the outer diameter of the housing 2 of the horizontal drilling device 1. The sheath 3 of the horizontal drilling device 1 in the region of the pit section rests thus more or less directly against the wall of the excavation pit 4. The fact that the inner diameter of the excavation pit and the outer diameter of the housing largely correspond to one another not only allows limiting the size of the excavation pit to be excavated to a minimum but also to achieve a most even support of the horizontal drilling device on a largest possible surface within the excavation pit 4. The circular cross section of the excavation pit 4 and the housing further render the support independent of the respective rotational orientation (about the longitudinal axis of the horizontal drilling device).

The excavation pit 4 was excavated by first introducing a ring-shaped groove having the required (outer) diameter into the surface sealing (asphalt cover) with a core drill (not shown), removing the thus exposed disc-shaped asphalt cover and subsequently sucking away the soil located underneath with a suction dredger (not shown). The suction dredger which was used for this purpose includes a suction nozzle which also has a circular cross section. The excavation pit 4 is excavated somewhat deeper than necessary to allow for height adjustment of the suspensory supported horizontal drilling device 1 inside the excavation pit 4, without causing an unintended touch down of the lower end of the horizontal drilling device 1 onto the pit bottom.

After excavation of the excavation pit 4, the horizontal drilling device 1 was lowered into the excavation pit 4 by means of a crane (not shown) until the support legs 7 which where previously fastened to the longitudinal supports 8 of the housing 2 come into contact with the ground surface. The horizontal drilling device 1 was then rotatively oriented by means of the crane within the excavation pit 4 by rotating the horizontal drilling device 1 about its longitudinal axis until the bore axis which is defined by the linear/rotational drive which is arranged inside the pit section of the horizontal drilling device 1 points into the desired starting direction for the pilot bore. A fine adjustment of the working height of the horizontal drilling device 1, and to a limited degree also the tilt of the horizontal drilling device 1 relative to the vertical, was then achieved via the spindle supports.

Because the wall of the excavation pit 4—in particular in the case when it was excavated by means of a suction dredger commonly is not configured evenly cylindrical, the horizontal drilling device 1 according to the invention has overall four support elements 15 in the region of the pit section which are evenly distributed across the circumference. These support elements 15 include support plates 16 which in a retracted position each form a section of the cylindrical sheath 3 of the horizontal drilling device. The support plates 16 can each be extended outward in radial direction by means of a hydraulic cylinder 17 to generate a direct contact of the horizontal drilling device 1 with the wall of the excavation pit 4 to securely support the horizontal drilling device 1 inside the excavation pit 4.

Figure 3:
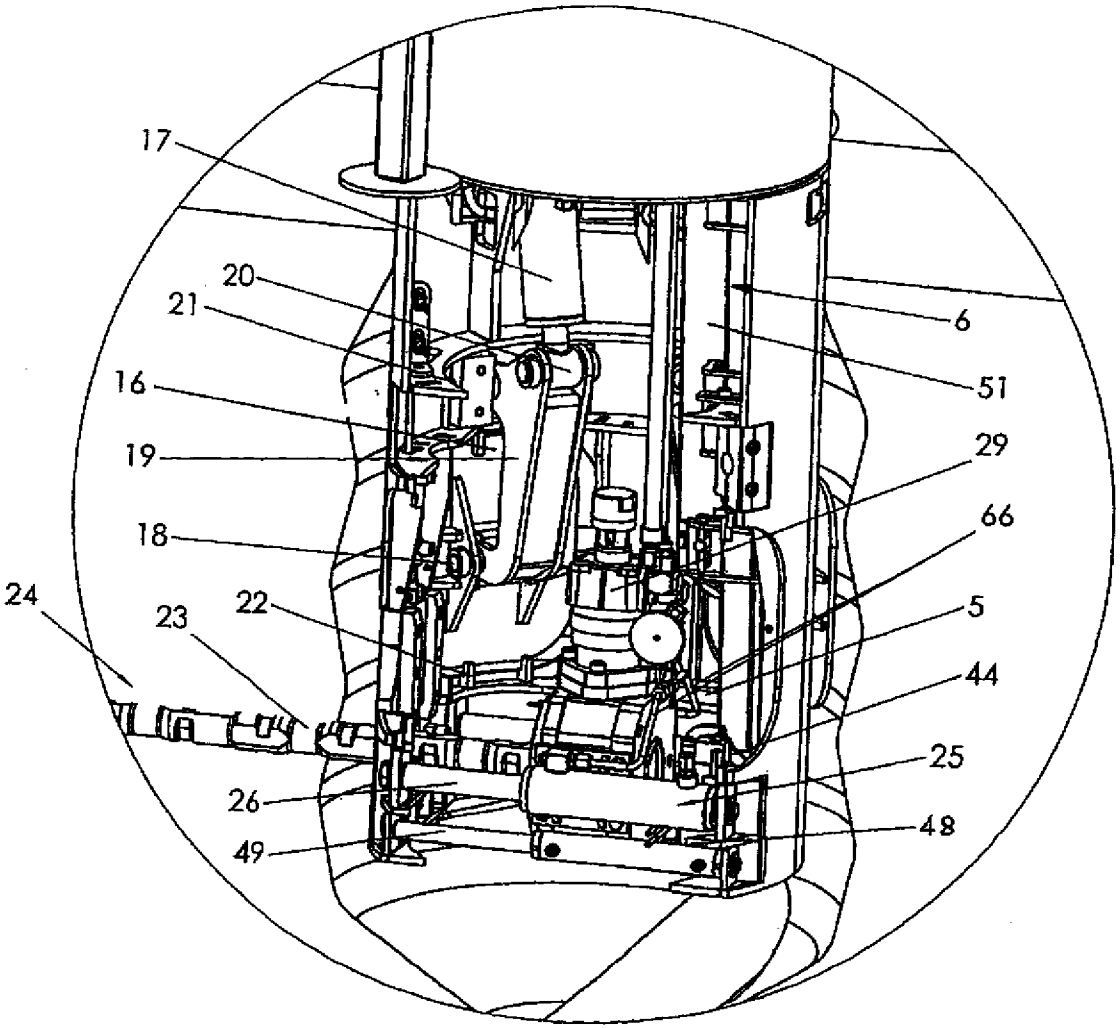
FIG. 3 an enlarged section of the representation according to FIG. 2.

The individual components of these support elements 15 are well recognizable in FIG. 3. Each of the support plates 16 is connected to a first end of an extension lever 19 via a first pivot joint 18, with the extension lever 19 being in turn rotatingly supported on the housing 2 of the horizontal drilling device 1 by means of a second pivot joint 21. A second end of the extension lever 19 is connected to the head of a piston rod 20 of the hydraulic cylinder 17. An extension or retraction of the hydraulic cylinder 17 thus causes a partial rotation of the extension lever 19 about the pivot joint 21, whereby the respective support plate 16 can be radially extended or retracted again. End stops 22 prevent that the support plate 16 enters the inner space defined by the sheath of the housing when retracting the hydraulic cylinder 17.

Figure 2:
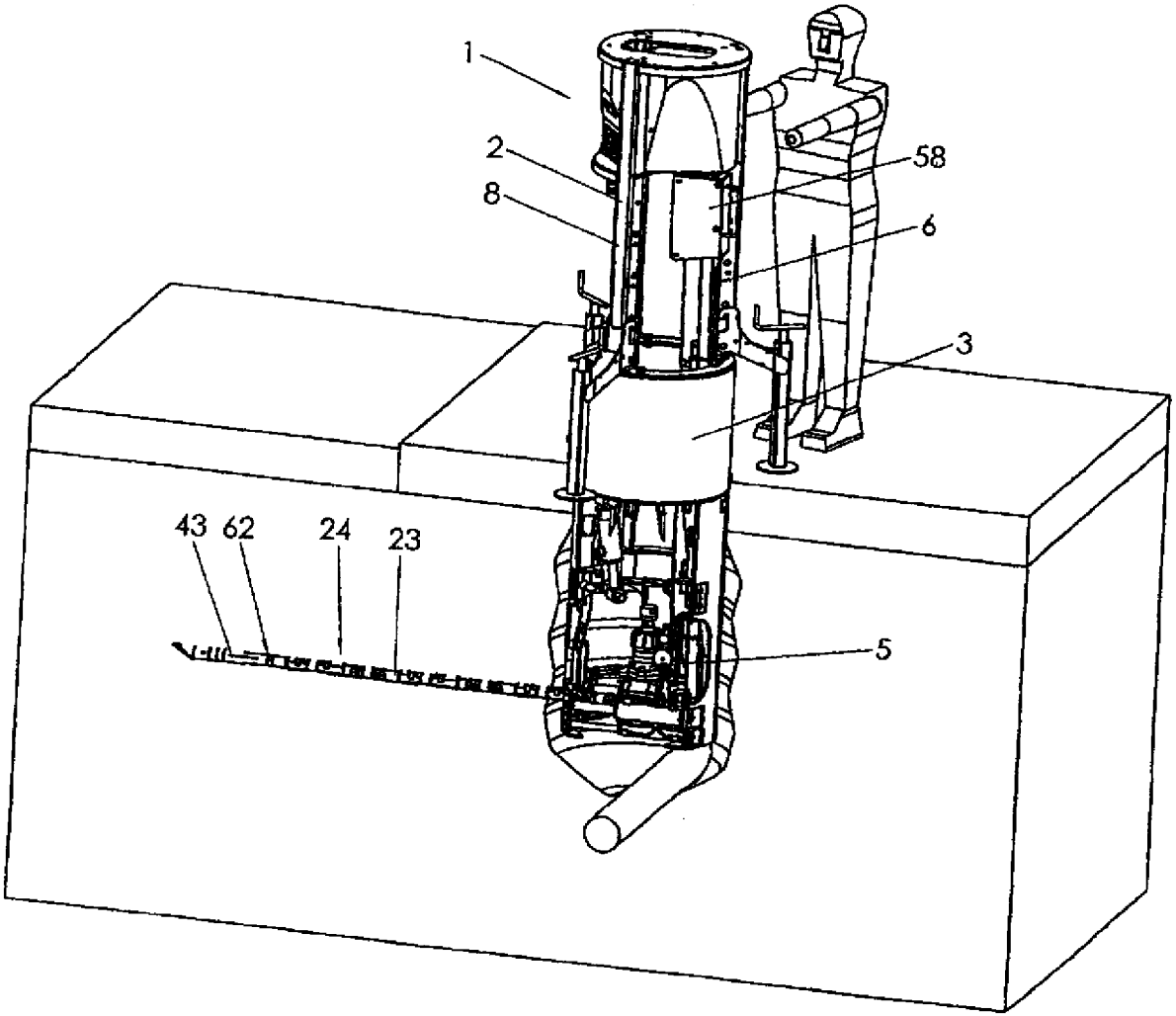
FIG. 2 the horizontal drilling device of FIG. 1 in a second perspective view.

FIG. 2 shows a representation of the entire horizontal drilling device 1 which corresponds to the representation of FIG. 1 in which, however, a part of the sheath 3 in the excavation pit is removed to show the functional elements arranged therein.

Figure 4:
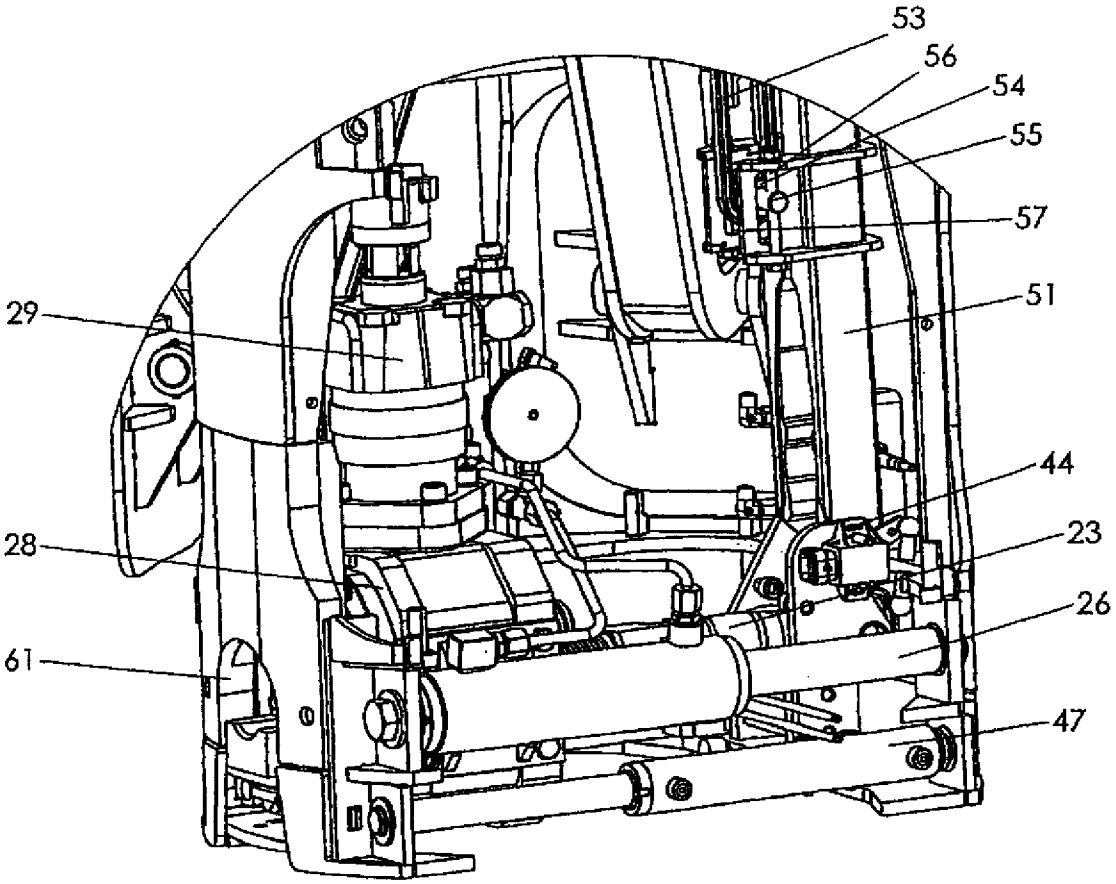
FIG. 4 the lower section of the horizontal drilling device according to FIGS. 1 to 3 in a perspective view.
Figure 5:
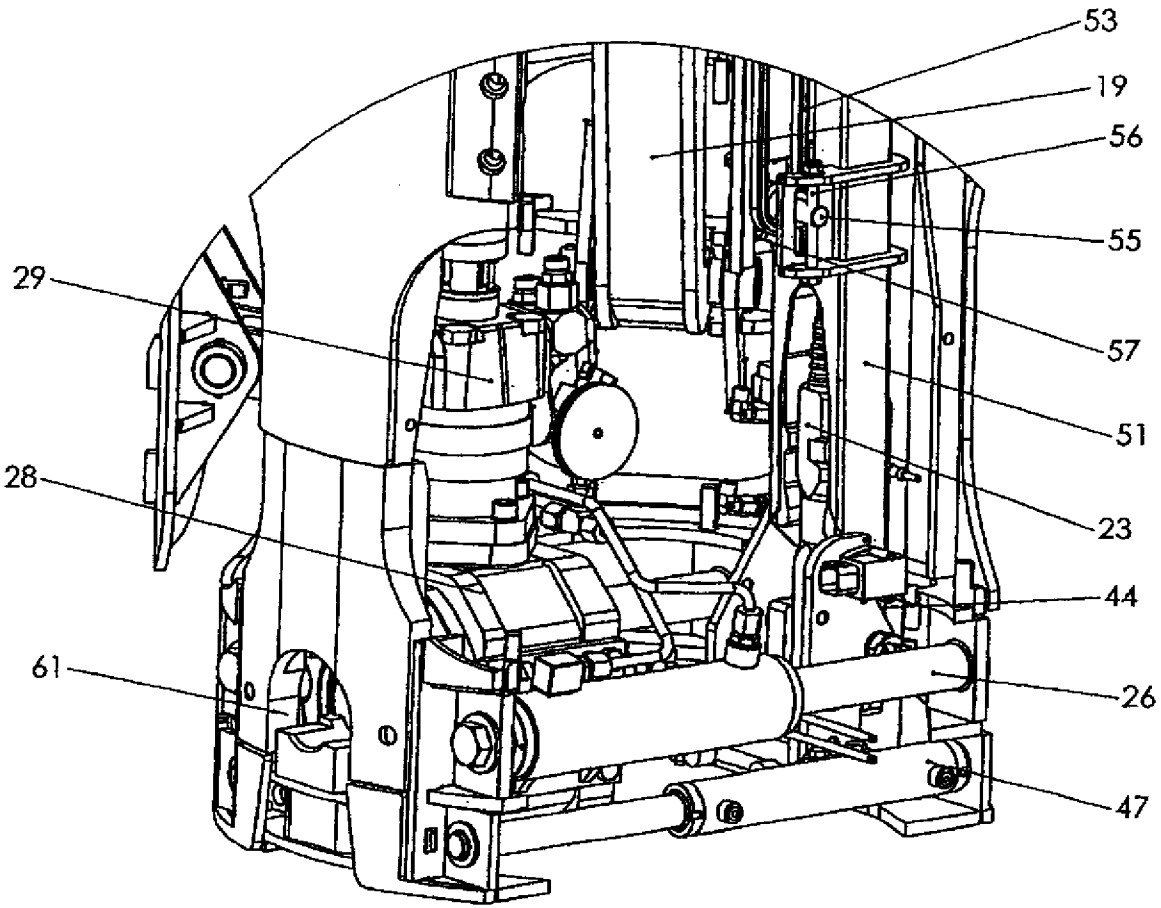
FIG. 5 the representation according to FIG. 4 in another operating position of the horizontal drilling device.

FIGS. 3 to 5 show different views of this section of the horizontal drilling device 1 in enlarged representations. It can be seen that the combined linear/rotational drive 5 at the lower end of the horizontal drilling device 1 is arranged within the housing 2. The linear/rotary drive 5 serves for rotatingly advancing a drill rod assembly which is composed of individual rod assembly sections 23, into the ground.

Figure 6:
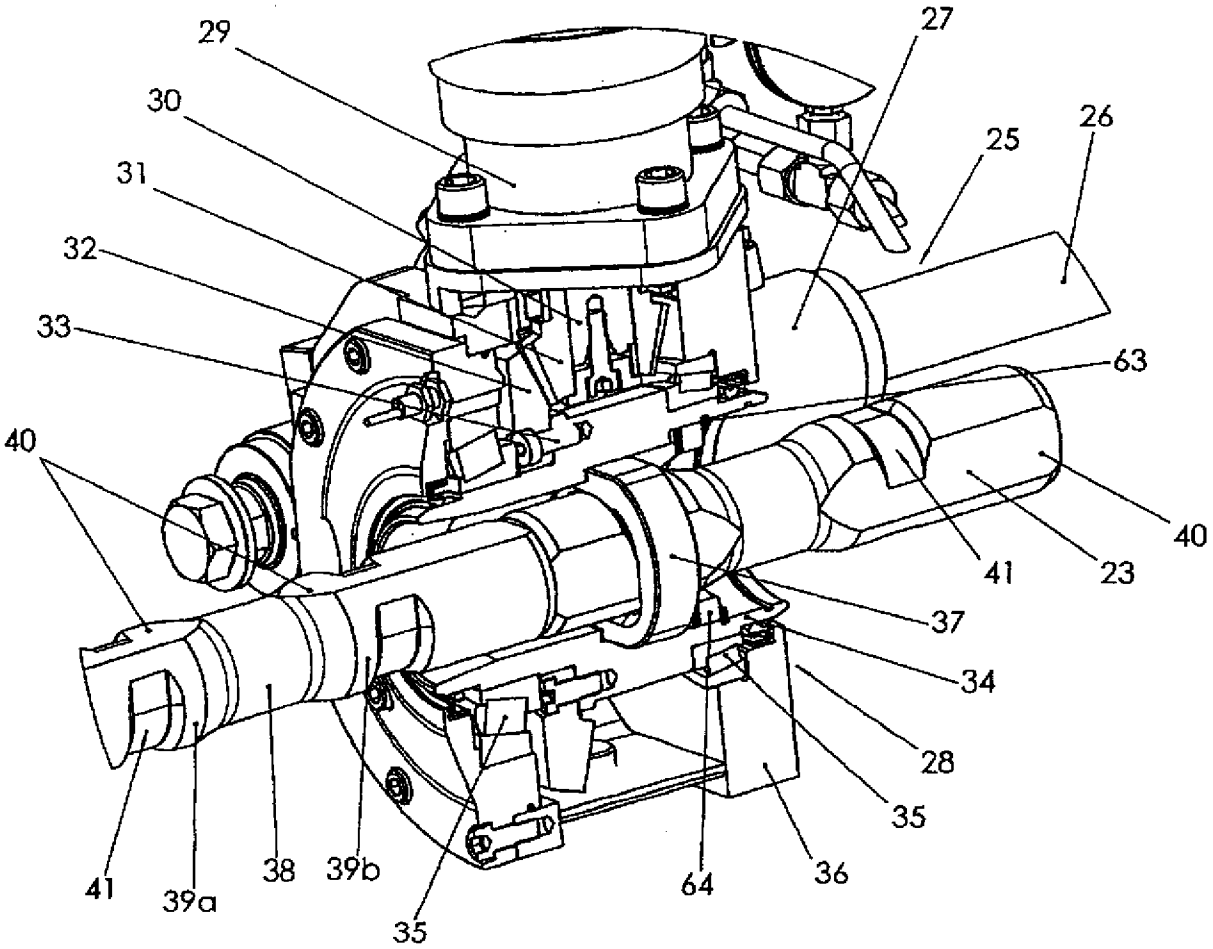
FIG. 6 an isolated representation of the rotational drive of the horizontal drilling device in a perspective view.

FIG. 6 shows a partial section through the linear/rotational drive 5 in a representation in which the linear/rotational drive 5 is isolated from the remaining elements of the horizontal drilling device 1. The linear/rotational drive 5 is formed by two hydraulic cylinders 25. The piston rods 26 of the two hydraulic cylinders 25 traverse the respective cylinder tube 27 completely and are connected with their two ends to the housing 2 of the horizontal drilling device 1. The piston rods 26 each have a centrally arranged piston (not shown) which divides the ring space which is respectively formed between the cylinder tube 27 and the piston rod 26, into two working chambers, which can each be supplied with hydraulic oil via a hydraulic line 66. Depending on the pressure of the hydraulic oil which is supplied to the individual working chambers, a movement of the respective cylinder tube 27 on the piston rod 26 in one or the other direction is achieved. The movement of the two hydraulic cylinders 25 of the linear drive is synchronized.

A rotational drive is arranged between the two cylinder tubes 27 of the hydraulic cylinders 25 which form the linear dive, and fastened to the two cylinder tubes 27. The rotational drive includes a motor 29 (in particular a hydraulic or electromotor) which is flange-mounted to a hollow gear 28. A drive shaft 30 of the motor 29 is connected with a differential gear wheel 31, which in turn meshes with a gear ring 32 which in turn is connected to a drive sleeve 34 via screw connections 33. The drive sleeve 34 is rotatingly supported within a housing 36 of the hollow gear 28 via two rolling bearings 35. A rotation of the drive shaft 30 of the motor 29 thus causes a rotation of the drive sleeve 34 about its longitudinal axis. This longitudinal axis corresponds essentially to the drill rod assembly 24 held therein and therefore also the drilling axis i.e., the starting direction of a pilot bore to be introduced or the longitudinal axis of a bore or an old pipe extending in the wall of the excavation pit 4.

For transmitting the rotational movement of the drive shaft 34 and the longitudinal movement which is generated by the hydraulic cylinders 25 of the linear drive to the drill rod assembly 24 which is held in the drive sleeve 34, a catch ring 37 is used which—in an operating position of the drill rod assembly 24 within the catch ring 37—fixes the drill rod assembly 24 in a form fitting manner. The catch ring 37 is form fittingly supported within the drive sleeve 34 and can be easily exchanged in case of wear, by first removing a retaining ring 63 from a corresponding groove in the inside of the drive sleeve 34 and then pulling out a spacer ring 64 from the drive sleeve. The catch ring 37 can then be easily pulled out of the drive sleeve 34.

Figure 9B:
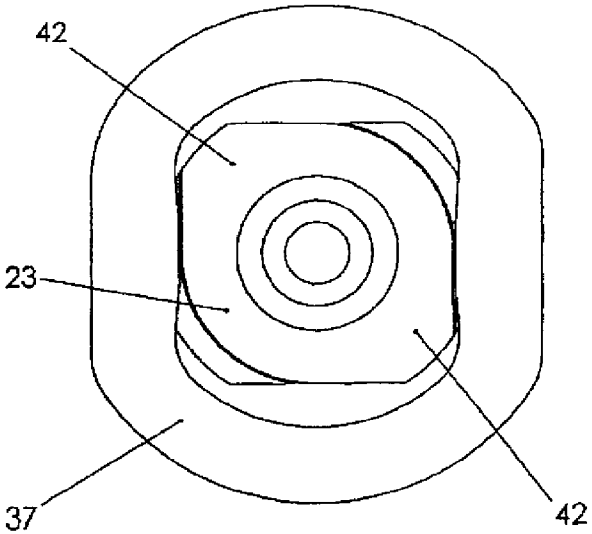
FIG. 9*b* a front view of the catch ring and the rod assembly section shown in FIG. 9*a;*
Figure 9A:
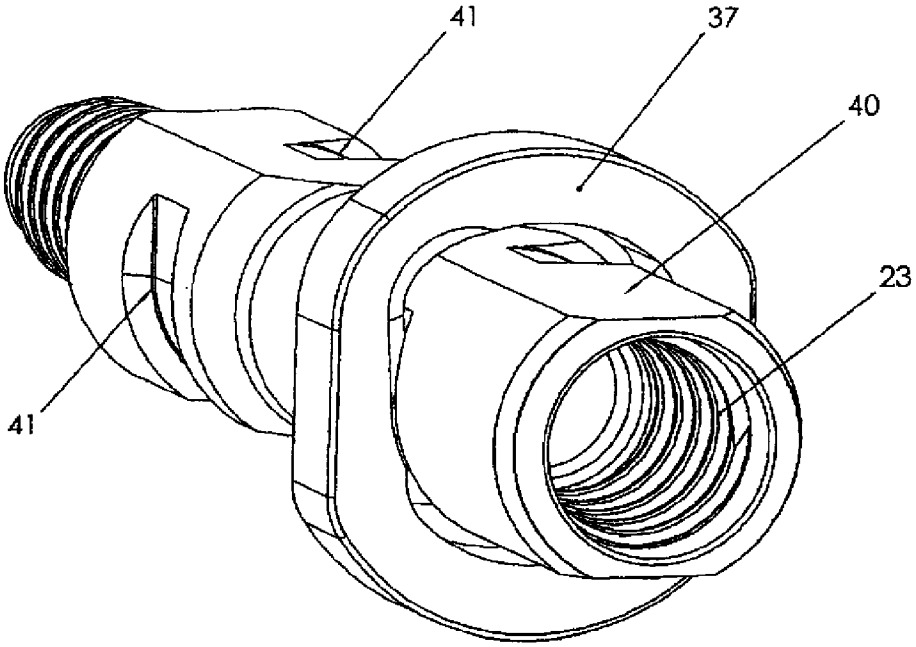
FIG. 9*a* an isolated representation of the catch ring of the rotational drive including a rod assembly section in a first operating position in an isometric view.

FIGS. 9*a* and 9*b* as well as 10*a* and 10*b* each show two views of the two operating positions of the drill rod assembly 24 within the catch ring 37 which are relevant for the operation of the horizontal drilling device 1. These two operating positions differ in a 90° relative rotation of the catch ring 37 about its longitudinal axis relative to the drill rod assembly 24. In the operating position shown in FIGS. 9*a* and 9*b* the drill rod assembly 24 is locked in the catch ring. This locking is achieved by the particular sheath shape of the rod assembly sections 23 of the drill rod assembly 24, and a shape of the central opening of the catch ring 37 which is adjusted thereto.

Figure 10B:
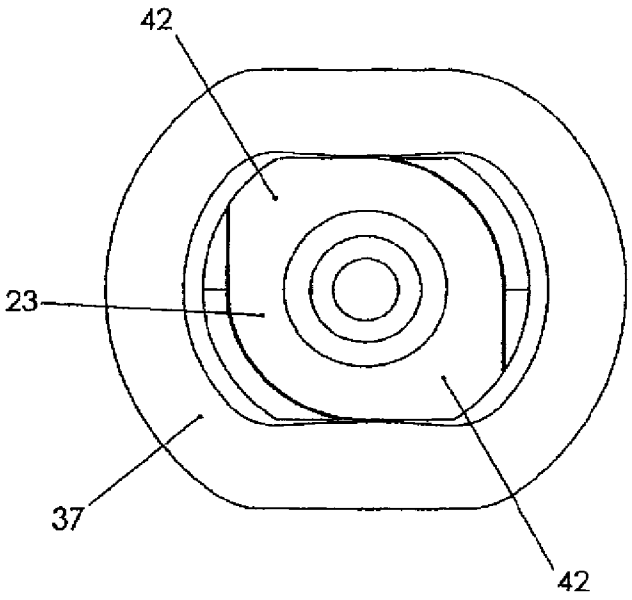
FIG. 10*b* a front view of the catch ring and the rod assembly section shown in FIG. 10*a*.
Figure 10A:
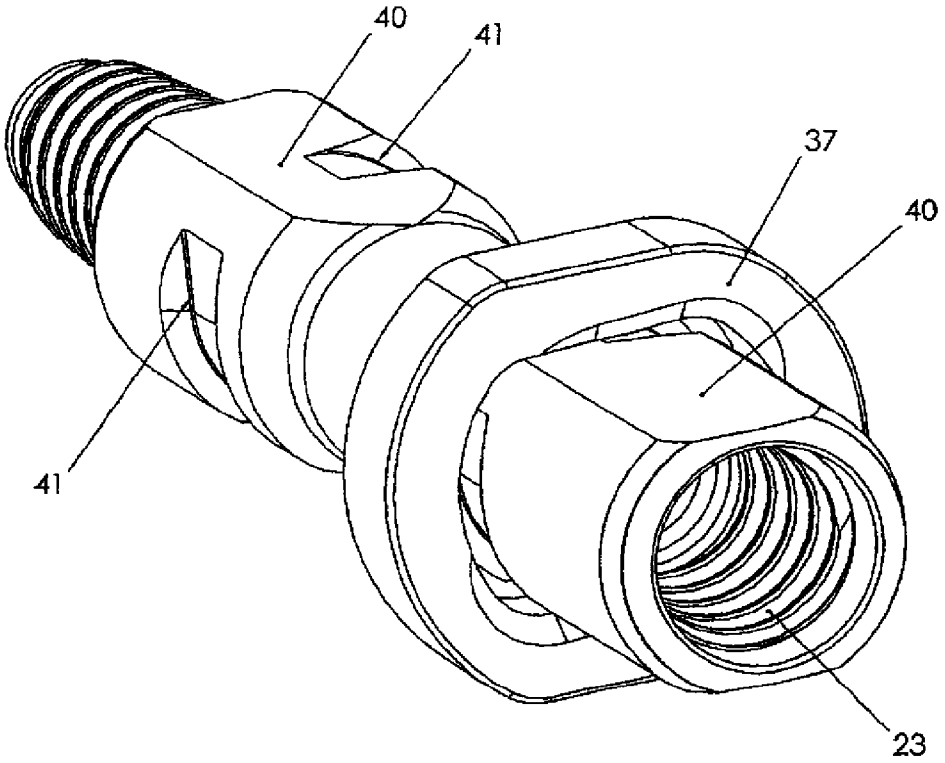
FIG. 10*a* an isolated representation of the catch ring of the rotational drive including a rod assembly section in a second operating position in an isometric view.

Each rod assembly section 23 of the drill rod assembly 24 has a cylindrical basic shape with a middle section 38 with a relatively small diameter and two end sections 39*a*, 39*b*, with a relatively large diameter. In each of the end sections 39*a*, 39*b* of a rod assembly section 23 two parallel flat portions 40 are provided, thereby resulting in a cross section with two parallel straight sides and two opposing arched-shaped sides. The catch ring 37 forms a through-opening which corresponds to this cross section so that it is possible to insert the rod assembly section 23 into the through opening of the catch ring 37 and to freely move it (in longitudinal direction) therein, when the catch ring 37 and the rod assembly sections 23 guided therein are arranged in the rotational orientation relative to one another shown in FIGS. 10*a* and 10*b*.

For locking the rod assembly section 23 in the catch ring 37, the catch ring 37 is moved inside the through-opening until two arched-shaped locking grooves 41 which are formed in each of the end sections 39*a*, 39*b* of the rod assembly section 23, are located within the catch ring 37. These locking grooves enable a relative clockwise rotation of the catch ring 37 by 90° into the operating position shown in FIGS. 9*a* and 9*b* (locking position). A rotation by more than 90° is also prevented by the fact that the two locking grooves 41 which are arranged offset to one another by 180° about the longitudinal axis of the rod assembly section 23, are only arch-shaped within an angular section of 90° and then extend straight. As a result of this, two cams 42 are formed whose distance is greater than the narrow width (corresponds to the two straight edges of the through-opening of the catch ring) of the through-opening for the catch ring 37. These cams 42 abut on the edges of the catch ring 37 in the locking position shown in FIGS. 9*a* and 9*b* and thus prevent a further (clockwise) rotation.

In the locking position of the rod assembly section 23 in the catch ring 37, longitudinal forces (in longitudinal direction of the rod assembly section axes) and a rotational torque (in FIGS. 9*a* to 10*b* clockwise) can be transferred to the entire drill rod assembly via the catch ring 37.

The center section 38 of each rod assembly section 23 has a reduced outer diameter in order to achieve a smaller (defined) bending stiffness relative to the end sections 39*a*, 39*b*. This is intended to enable the use of a controllable slanted drill head. By redirecting the drill head 43 in the soil, a drilling course which is arched in sections is achieved. The drill rod assembly 24 has to adjust to this arched drilling course which leads to a corresponding bending stress. The center section 38 of each rod assembly section 23 which has a reduced diameter and is thus relatively bending soft compared to the end sections 39*a*, 39*b*, serves for maintaining the rod assembly section 23 overall bending soft, however, at the same time serves for configuring the end sections 39*a*, 39*b* stiff which, due to the threads are particularly at risk of breaking.

Due to the arrangement of the combined linear/rotational drive 5 at the lower end of the pit section of the horizontal drilling device 1, and due to the smaller dimensions of the horizontal drilling device 1 (the housing 2 has a maximal diameter of about 60 cm) the individual rod assembly sections 23 cannot be manually fed to the linear/rotational drive 5. Rather, an automated rod assembly feed is provided for this purpose which is formed by a rod assembly receiver 44, which is arranged at the height of the linear/rotational drive 5 and the rod assembly lift 6.

The rod assembly receiver 44 is shown in the overall representation of FIGS. 4 and 5 and by itself in the representations of FIGS. 7*a*, 7*b*, 8*a* and 8*b*. The central element of the rod assembly receiver 44 is a receiving mandrel 45 which is supported in a bridge 46 which is connected to the two cylinder tubes 47 of two further hydraulic cylinders 48. The hydraulic cylinders 48 are also of the kind in which the piston rod 49 protrudes out of the cylinder tube 47 on both sides. The two free ends of the two piston rods 49 are connected to the housing 2 of the horizontal drilling device 1 so that by a corresponding impingement of the hydraulic cylinders 28 with hydraulic oil, the cylinder tubes 47 and thus the rod assembly receiver 44 can be displaced on the stationary piston rods 49 in horizontal direction.

Figure 7B:
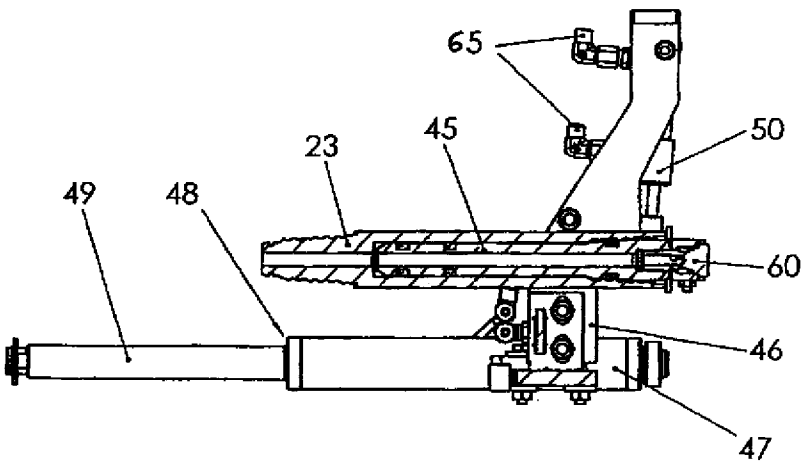
FIG. 7*b* an isolated representation of the rod assembly receiver of the horizontal drilling device in a first operating position in a sectional view.
Figure 7A:
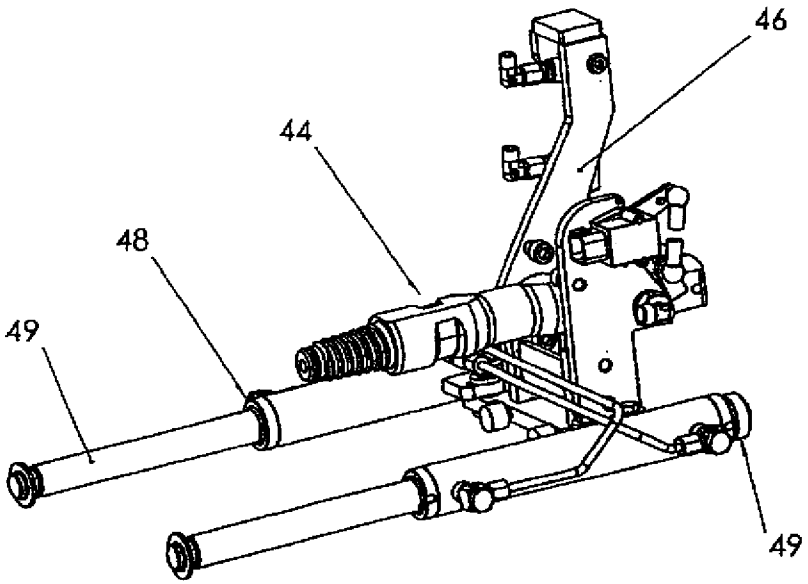
FIG. 7*a* an isolated representation of the rod assembly receiver of the horizontal drilling device in a first operating position in a perspective view.
Figure 8B:
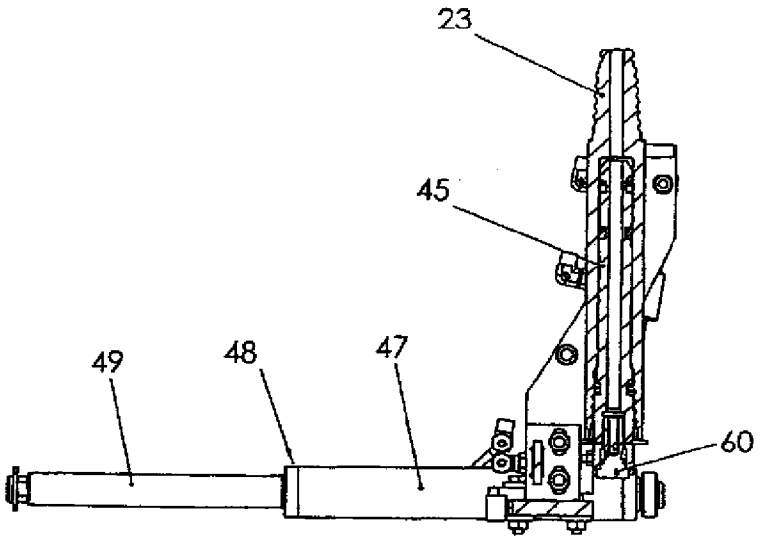
FIG. 8*b* an isolated representation of the rod assembly receiver of the horizontal drilling device in a second operating position in a sectional view.
Figure 8A:
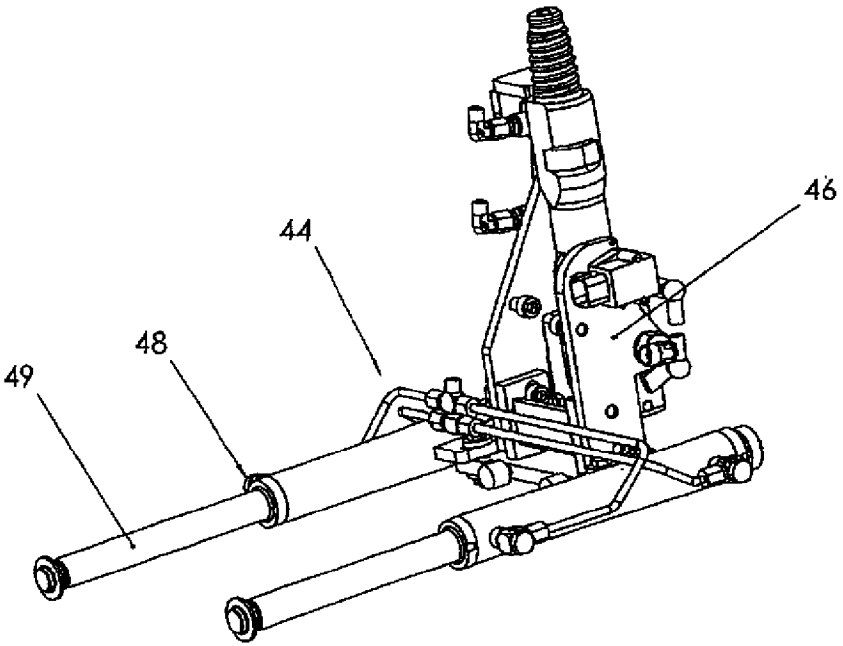
FIG. 8*a* an isolated representation of the rod assembly receiver of the horizontal drilling device in a second operating position in a perspective view.

The receiving mandrel 45 of the rod assembly receiver 44 is supported within the bridge 46 for pivoting about a horizontal axis, wherein a pivoting between the two end positions shown on one hand in FIGS. 7*a*, 7*b* and on the other hand 8*a*, 8*b* is possible. The pivoting is achieved via a further hydraulic cylinder 50 which is supplied with hydraulic oil via corresponding hydraulic connections 65.

In the orientation shown in FIGS. 7*a*, 7*b*, the longitudinal axis of the receiving mandrel 45 and a rod assembly section 23 attached onto the receiving mandrel 45 is coaxial to the drive sleeve 34 of the rotational drive and thus points in the drilling direction of the horizontal drilling device 1. In the vertical operating position shown in FIGS. 8*a*, 8*b* which is thus pivoted by 90° relative to the operating position according to FIGS. 7*a* and 7*b*, the receiving mandrel 45 and the rod assembly section 23 attached onto it are positioned within a guiding track 51 of the rod assembly lift 6. In this operating position of the receiving mandrel 45, a rod assembly section 23 can be attached onto the receiving mandrel 45 from the rod assembly lift 6 or removed from the latter.

Within the guiding track 51 of the rod assembly lift 6, a receiving sled 52 which can receive a rod assembly section 23, is movably guided, wherein the receiving sled 52 is fastened at a trumm of a drive belt 53 which extends outside of the guiding rail 51 and parallel to the latter. An upper driving roller of the driving belt 53 is connected to the motor (not shown) in order to drive the latter. A lower deflection roller 54 is supported on an axle 55 which is guided at both its ends on a threaded rod 56. By rotating the threaded rods 56, the vertical position of the lower deflection roller 54 can be changed so as to tension the driving belt 53. By means of the driving belt 53 the receiving sled 52 can be moved up and down in the guiding track 51. In this way a rod assembly section 23 which is inserted into a loading station 58 in the surface section of the horizontal drilling device 1 by operating personnel, can be transported to the rod assembly receiver 44 in the pit section—and vice versa.

Figure 11:
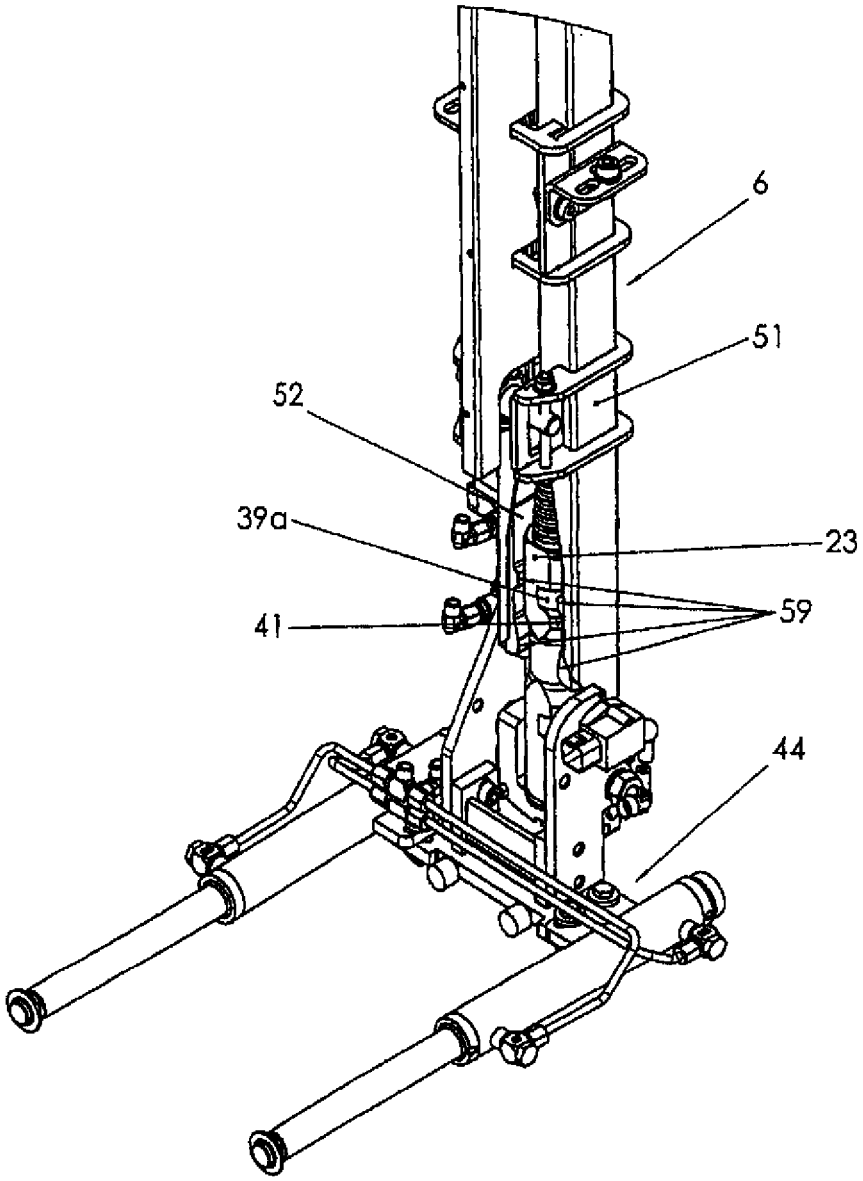
FIG. 11 an isolated representation of the rod assembly receiver and the lower section of the rod assembly lift in an isometric view.

FIG. 11 shows in an isolated representation of the rod assembly receiver 44 and the lower part of the rod assembly lift 6 including the receiving sled 52 in which a rod assembly section 23 is held. The receiving sled 52 forms a through-opening in which the rod assembly section 23 can be inserted from the side by the operating personnel in the region of the loading station 58. In the receiving sled 52 the inserted rod assembly section is supported suspensory, i.e., two pairs of projections 59 each form a free space which is only slightly broader than the diameter of the center section 38 and narrower than the broader side of the end sections 39*a*, 39*b* of the rod assembly section 23. One of the projection pairs engages into the locking grooves 41 of the front end section 39*a*, while the second projection pair engages in the center section 38 of the rod assembly section 23. Via the two projection pairs of the receiving sled 52, the rod assembly section 23 fixed therein is form fittingly held (in vertical and lateral direction). Of course it is also possible to use only one projection pair or only one single projection to hold the rod assembly section 23 within the receiving sled 52.

By lowering the receiving sled 52 within the guiding track 51 of the rod assembly lift 6, the rod assembly section 23 which is held in the receiving sled 52 is attached onto the vertically oriented receiving mandrel 45 (compare FIG. 5 [receiving sled not shown] and 8*a*, 8*b*) The receiving mandrel is then pivoted by 90° into the horizontal operating position shown in FIGS. 4 and 7*a*, 7*b*, whereby the rod assembly section 23 is pivoted in lateral direction out of the receiving sled 52. The receiving sled 52 can then be moved to the loading station 58 again so that a further rod assembly section 23 can be inserted.

The rod assembly section 23 which is attached onto the receiving mandrel 45 can be secured against axially sliding off from the receiving mandrel 45. For this, a hydraulically actuatable piston can be provided which is arranged end-side perpendicular to the longitudinal axis of the rod assembly section 23 on the bridge 46. The piston of the cylinder can be extended on its end side into a groove which is formed outside on the rod assembly section 23. The groove has a greater dimension in the direction of the longitudinal axis of the rod assembly section 23 than the piston which can be moved into the groove, so that a certain axial play between the rod assembly section 23 and the receiving mandrel 45 is possible, however, a sliding off of the piston which is in engagement with the groove is prevented. To remove the rod assembly section 23 from the receiving mandrel 45 the piston is retracted into the cylinder or out of the groove.

The horizontal drilling device 1 is configured for carrying out flush drillings i.e., a drilling fluid is supplied via the rod assembly 24 to the drill head 43 which is arranged on the front side of the rod assembly 24, which drilling fluid exits through front side and lateral exit openings. To enable the supply of drilling fluid to the drill head 43, the individual rod assembly sections 23 of the drill rod assembly 24 are configured continuously hollow. The drilling fluid is supplied to the drill rod assembly 24 via the receiving mandrel 45 which for this purpose is also configured continuously hollow. Only on the rear side end i.e., the end which protrudes out of the attached rod assembly section 23, the receiving mandrel is closed by means of a screw cap 60. The drilling fluid is supplied to the inner space which is formed by the hollow receiving mandrel 45 via a shaft which is also configured hollow and on which the receiving mandrel is rotatingly supported. Two sealing rings on the outside of the receiving mandrel 45 prevent a leaking of the drilling fluid through the gap between the receiving mandrel 45 and the rod assembly section 23. This allows easily achieving a secure and constructively simple connection of the pivotal receiving mandrel 45 to the source of the drilling fluid. In contrast, a connection to the drilling fluid source while at the same time maintaining the pivotability of the receiving mandrel via flexible supply tubes requires more constructive effort, because the high pressure with which the drilling fluid is supplied to such a rod assembly 24 necessitates the use of extremely pressure resistant and with this poorly elastic supply tubes, which in turn would impede the pivoting movement of the receiving mandrel 45, which would require a greater and higher powered hydraulic cylinder 50 for the pivoting.

For generating a pilot bore, the horizontal drilling device 1 is used as follows.

Before lowering of the horizontal drilling device 1 into the excavation pit 4, the drill head 43 shown in FIG. 1 is inserted into the drive sleeve 34 of the rotational drive through a through-opening 61 for the drill rod assembly which through-opening 61 is formed in the housing 2. This is necessary because the drill head has an integrated transmitter for localization by means of a so called walk-over-receiver and is therefore longer than the rod assembly sections 23. The drill head has a (rear) end section 62 which corresponds to the end sections 39*a*, 39*b* of the rod assembly sections 23 with regard to the geometric shape: Two arch-shaped locking grooves are introduced into the end section 62 with a cylindrical basic shape which is provided with parallel flat portions on two opposing sides, into which grooves the catch ring 37 can be rotated by a 90° clockwise rotation, whereby the drill head 43 is locked in the rotational drive. The rotational drive is located in the rear most position in which the latter can be driven as far as possible away from the through-opening 61 by means of the linear drive.

The horizontal drilling device 1 is then lowered into the excavation pit 4, oriented and supported, as already described.

By using the linear/rotational drive 5 the drill head is then drilled into the soil as far as possible. Due to the length of the drill head 43 the drilling occurs with two strokes of the linear drive; in the first stroke the catch ring 37 is located at the front end of the two parallel flat portions so that the pressure forces are transferred over the protrusion formed there, and the rotational torque is transferred via the parallel flat portions which serve as wrench flats. After the first stroke, the linear drive is retracted so that the catch ring 37 can engage in the locking grooves and lock the drill head 43. After this, the linear drive is moved forward again, whereby the drill head 43 is completely drilled in. The rotational drive is then located in the front most position shown for example in FIGS. 4 and 5. A locking fork (not shown) provided in the region of the through-opening is then lowered. The fork width of the locking fork corresponds to the distance of the two parallel flat portions of the drill head 43 and the distance of the two locking grooves. Previously, the drill head 43 was oriented by means of the rotational drive so that the two flat portions of the end section are oriented vertically so that the locking fork can travel over the end section (in a section before the locking grooves) of the drill head 43, thereby temporarily preventing a rotation of the drill head 43 by means of a form fitting fixing.

During the advancement of the drill head 43 into the soil, a first rod assembly section 23 was already inserted into the receiving sled 52 by an operating person and by displacing the rod assembly lift 6 attached onto the receiving mandrel 45. After pivoting of the receiving mandrel 45 and the rod assembly section attached thereto, by 90° into its horizontal orientation, the rod assembly section 23 is in a predominantly coaxial position relative to the already drilled drill head 43. By displacing the two hydraulic cylinders 48 of the rod assembly receiver 44, the front side of the threaded plug of the rod assembly section 23 can be driven to the rear side threaded socket of the drill head 43. The catch ring 37 is then released from the locking grooves of the drill head 43 and the linear/rotational drive 5 retracted until it is located in a defined region of the front end section 39*a* of the first rod assembly section 23. By actuating the rotational drive, the first rod assembly section 23 is screwed together with the drill head 43 which is fixed in rotational direction by the locking fork, wherein the rotational torque is transferred via the parallel flat portions 40. Due to the fact that the catch ring 37 is not yet locked in the locking groove 41, the rod assembly section can move in axial direction relative to the catch ring 37 during screwing. This allows realizing the longitudinal movement of the rod assembly section 23 which is necessary for the screwing of the rod assembly section 23 without an elaborate length compensation which is realized by the linear drive.

The position of the rotational drive during the screwing is chosen so that the locking grooves 41 of the front end section 39*a* are located within the catch ring 43 after the rod assembly section 23 is completely screwed together with the drill head 43 so that the catch ring 37, after a rotation of 90°, can engage directly i.e., without necessitating a further displacement of the linear drive, in the locking grooves 41 to fix the rod assembly section 23 also in longitudinal direction. The drill rod string is then drilled until the rotational drive reaches its front end-position again.

After this, the rotational drive is unlocked by a 90° rotation (in the opposite direction) of the catch ring and retracted by means of the hydraulic cylinder 25 of the linear drive until the catch ring 37 can engage in the locking grooves 41 of the rear end section 39*b* of the first rod assembly section 23; there, the catch ring 37 is locked again by a 90° rotation. Then, the drill rod string composed of the drill head 43 and the first rod assembly section 23, is advanced into the soil by a further working stroke of the linear drive by using the linear/rotational drive.

As soon as the rotational drive has reached its front end position, the rod assembly receiver 44 is moved back into the rear position and the receiving mandrel 45 is pivoted into the vertical position where the latter can receive a second rod assembly section 23 which was already inserted into the receiving sled 52 by the operating personnel which receiving sled 52 was moved into the loading station 58.

After finishing the working stroke of the linear drive, the locking grooves of the front end section 39*a* of the first rod assembly section 23 are located below the locking fork which can then be lowered to fix the drill rod string, while the second rod assembly section 23 is screwed to the existing drill rod string. For this, the second rod assembly section 23 is moved to the rear end of the first rod assembly section 23 by means of the rod assembly receiver 44. At the same time, the rotational drive is released from the first rod assembly section 23 and moved backwards until it can engage on the parallel flat portions 40 in the front end section 39*a* of the second rod assembly section 23. By using the linear/rotational drive 5, the second rod assembly section 23 is then screwed to the first rod assembly section 23, wherein after finishing the screwing, the catch ring 37 locks again in the locking grooves 41 of the front end section 39*a* of the second rod assembly section and the drill rod string is drilled until reaching the front end position (of the linear drive) again. The linear/rotational drive 5 is then released from the second rod assembly section 23 by a 90° relative rotation of the catch ring 37 and moved backwards again to lock the second rod assembly section 23 in the rear end section 39*b* and to advance the drill rod string into the soil again by a further working stroke.

In contrast to the drill head 43, the locking fork engages in the locking grooves 41 of the rod assembly sections 23 to lock the latter not only rotatively but also against a movement in longitudinal direction. This allows preventing the drill rod string from unintentionally becoming displaced due to elastic re-deformation of the compressed soil and the drill rod assembly which has been compressed or stretched by the loads.

The attachment and drilling of further rod assembly sections 23 occurs in an identical manner.

After the pilot bore is complete, the drill head 43 can be replaced by a widening device (not shown) to widen the bore during retraction of the drill rod assembly. Optionally, a new pipe (not shown) or another supply line (not shown) can be attached to the widening head which is drawn into the bore simultaneous with the widening device.

When retracting the drill rod assembly 24, the latter is shortened step by step by one rod assembly section 23 at a time. This occurs in the following manner.

The catch ring 37 of the rotational drive is locked in the locking grooves 41 of the rear end section 39*b* of the last rod assembly section 23. The rotational drive is moved backwards by displacing the hydraulic cylinders 25 of the linear drive. The locking fork is then lowered and fixes the second to last rod assembly section 23 by engaging of the locking fork in the rear end section 39*b* of this rod assembly section 23. The linear/rotational drive 5 is then released from the rod assembly section 23 by a 90° rotation of the catch ring and moved forward again until the catch ring 37 can engage in the locking grooves of the front end section 39*a* of the last rod assembly section 23. By a further working stroke of the linear drive the drill rod assembly 24 is pulled out of the soil as far as to enable the locking fork to lock the second to last rod assembly section 23 in the front end section 39*a*. Then, the last rod assembly section 23 can be screwed off from the second to last rod assembly section 23 by a counter clockwise rotation of the drive sleeve 34. Due to the particular shape of the rod assembly section in the region of the end sections, a rotational torque can be transferred for releasing the threaded connection without the catch ring 37 being fixed in the locking groove 41 also in longitudinal direction. This allows the catch ring 37 to slide over the rod assembly section according to the thread pitch, which allows avoiding a length compensation via the linear drive. Simultaneously, the rod assembly receiver 44 moves forward to receive the unscrewed last rod assembly section 23. The rod assembly receiver 44 then moves to its rear most position again and the linear/rotational drive 5 moves simultaneously forward so that the latter can engage on the rear end section 39*b* of the then last (before second to last) rod assembly section 23. The screwed-off rod assembly section 23 is then completely moved out of the drive sleeve 34 and can be inserted into the receiving sled 52 of the rod assembly lift 6 by pivoting of the receiving mandrel 45 into the vertical position. The receiving sled 52 can then be moved upwards to the loading station 58 where the rod assembly section can be retrieved by an operating person.

In the same manner, all rod assembly sections are successively released from the horizontal drilling device.

The shown horizontal drilling device is appropriate for use in non-urban environments and in particular for the generation of house connections in the supply field (in particular gas, water, electricity, fiber glass, etc). Bores of at least 20 m in length can be introduced which are then used for drawing in pipes or cables with an outer diameter of up to 63 mm.

The invention claimed is:

1. A horizontal drilling device, comprising:

a linear drive;

a rotational drive displaceable by the linear drive; and a rod assembly receiver including a receiving mandrel for being received in a hollow interior portion of a drill rod assembly and for transporting the drill rod assembly at least one of into or out of engagement with the rotational drive, wherein the receiving mandrel is configured such that, when the mandrel is received in the hollow interior portion of the drill rod assembly, the rod assembly is independently rotatable about a longitudinal axis of the receiving mandrel and moveable axially along the longitudinal axis of the receiving mandrel, and wherein the receiving mandrel is pivotal relative to the rotational drive between a first position and a second position, said first position being parallel to a direction of movement of the linear drive.

2. The horizontal drilling device of claim 1, wherein the second position is oriented substantially perpendicular to the first position.

3. The horizontal drilling device of claim 1, further comprising a rod assembly lift for transporting a rod assembly section of the drill rod assembly to the receiving mandrel.

4. The horizontal drilling device of claim 3, wherein the rod assembly section is attachable from the rod assembly lift onto the receiving mandrel when the receiving mandrel is in the second position, and wherein the rod assembly section is transferable to the rotational drive when the receiving mandrel is in the first position.

5. The horizontal drilling device of claim 4, further comprising a travel drive coupled to the rod assembly receiver for displacing the rod assembly receiver relative to the rotational drive.

6. The horizontal drilling device of claim 1, further comprising a supply for a drilling fluid connected to the receiving mandrel, wherein the receiving mandrel is configured hollow.

7. The horizontal drilling device of claim 6, further comprising a connection for connecting the supply for the drilling fluid to the receiving mandrel, wherein said connection is integrated in a pivot joint of the receiving mandrel.

8. The horizontal drilling device of claim 1, wherein in the second position, an axis of the rod assembly engaged by the receiving mandrel is oriented substantially nonparallel to an axis of the rotational drive, and wherein in the first position, the axis of the rod assembly engaged by the receiving mandrel is oriented substantially parallel to the axis of the rotational drive.

9. The horizontal drilling device of claim 1, further comprising a linear actuator for pivoting the receiving mandrel between the first and second positions.

* * * * *